US005169499A

United States Patent [19]

Eagles et al.

[11] Patent Number: 5,169,499

[45] Date of Patent: Dec. 8, 1992

[54] PAPER MACHINE FELTS OF A COPOLYMER OF 1,4-DIMETHYLOLCYCLOHEXANE, TEREPHTHALIC ACID, AND ISOPHTHALIC ACID

[75] Inventors: Dana B. Eagles, Sherborn; Jeanne A. Leon, Westwood; Francis Ditaranto, Plainville, all of Mass.

[73] Assignee: Albany International Corp., Albany, N.Y.

[21] Appl. No.: 678,292

[22] PCT Filed: Apr. 23, 1990

[86] PCT No.: PCT/GB90/00623

§ 371 Date: Apr. 4, 1991

§ 102(e) Date: Apr. 4, 1991

[87] PCT Pub. No.: WO90/12918

PCT Pub. Date: Nov. 1, 1990

[30] Foreign Application Priority Data

Apr. 24, 1989 [GB] United Kingdom ..... 8909291
Jun. 15, 1989 [GB] United Kingdom ..... 8913731
Nov. 6, 1989 [GB] United Kingdom ..... 8924996

[51] Int. Cl.[5] ..... D21F 7/08; D01F 6/62

[52] U.S. Cl. ..... 428/175; 162/358; 162/DIG. 1; 428/234; 428/287

[58] Field of Search ..... 162/348, 358, DIG. 1; 428/234, 287; 34/243

[56] References Cited

FOREIGN PATENT DOCUMENTS 502933 8/1979 Australia .
158710 10/1985 European Pat. Off. .
1222205 8/1966 Fed. Rep. of Germany .
83/01253 4/1983 PCT Int'l Appl. .

*Primary Examiner*—Karen M. Hastings
*Attorney, Agent, or Firm*—Kane, Dalsimer, Sullivan, Kurucz, Levy, Eisele & Richard

[57] ABSTRACT

This invention relates to a paper machine clothing having improved hydrolysis resistance and suitable for use in the forming, pressing or drying sections of a paper making machine, and has particular reference to paper making machine clothing used in the dryer section of a paper making machine, such as through air drying fabrics, and dryer screens.

According to one aspect of the present invention, there is provided an article of paper making machine clothing suitable for use in the forming, pressing or drying sections of a paper making machine which article includes a fibre structure characterized in that the fibres of said structure comprise a polyester material having a hintered carboxyl group and in that said fibres have a melting point greater than 260° C. The fibres are a copolymer of terephthalic acid, 1,4-dimethylolcyclohexane and isophthalic acid.

15 Claims, 4 Drawing Sheets

PAPER MACHINE FELTS OF A COPOLYMER OF 1,4-DIMETHYLOLCYCLOHEXANE, TEREPHTHALIC ACID, AND ISOPHTHALIC ACID

DESCRIPTION

This invention relates to paper machine clothing suitable for use in the forming, pressing or drying sections of a paper making machine and has particular reference to paper making machine clothing used in the dryer section of a paper making machine, such as through air drying fabrics, and dryer screens.

In paper making machines, a slurry of paper making constituents referred to as "furnish" is deposited on a fabric or "wire" and the liquid constituent of the furnish is drawn or extracted through the fabric or wire to produce a self-cohesive sheet. This cohesive sheet is passed to a pressing and drying section of a paper making machine. In the pressing section of the machine, the paper sheet is transported by a felt to a pair of rollers where the felt and paper sheet are passed between the nip of the rollers to dewater and dry the paper sheet. The paper sheet itself may contain all types of chemical finishes and will be at the same time, subjected to an elevated temperature in order to aid the dewatering and drying thereof.

After pressing the paper sheet passes to the drying section of the machine where it is dried at an elevated temperature. The fabric in the drying section of the machine together with its sheet of paper tends to be subjected to elevated temperatures in a rigorous chemical environment. Dryer fabrics or "dryer screens" employed in the paper making industry have, traditionally, been formed from a variety of materials such as poly(ethylene terephthalate), polyphenylene sulfide and polypropylene. Each material has different properties and pricing, which affects its relative position in the marketplace. An important property for any material used as a drier screen in a paper making machine is that the material should have good hydrolytic stability and good dimensional stability.

Polypropylene is the cheapest material presently available; it has excellent hydrolytic stability, but poor dimensional stability at elevated temperature, and as a result it has only limited use.

Poly(ethylene terephthalate) (PET) is moderately priced, has exceptional dimensional stability and reasonable hydrolytic stability. Poly(ethylene terephthalate) is the predominant material currently used in the marketplace and in most cases, the hydrolytic stability of poly(ethylene terephthalate) can be improved by the addition of carbodiimide stabilisers. Polyphenylene sulfide has excellent dimensional and hydrolytic stability, but suffers from the disadvantage that it is extremely highly priced, is more difficult to work, and tends to suffer from brittle fracture problems in the crystalline state due to normal flexing experienced on the paper machine.

According to one aspect of the present invention, there is provided an article of paper making machine clothing suitable for use in the forming, pressing or drying sections of a paper making machine which article includes a fibre structure characterised in that the fibres of said structure comprise a polyester material having a hintered carboxyl group and in that said fibres have a melting point greater than 260° C. The fibres may have a creep extension of less than 10% at 1.1 grams per denier.

For the purposes of this specification fibre refers to a shaped polymeric body of high aspect ratio capable of being formed into two or three dimensional articles as in woven or nonwoven fabrics. Fibre further refers to staple, multifilament or monofilament forms. Melting point is defined in this context as the temperature of the highest peak on the endotherm of the plot produced via Differential Scanning Calorimetry. By way of example of how melting point is determined FIG. 1 (hereinafter referred to) is a graph of a Differential Scanning Calorimetry response of a commercial polyester with a melting point of 255° C.

In another aspect of the present invention, the fibres may additionally have an initial modulus greater than 25 grams per denier, an elongation at break of greater than 15% and a tenacity of greater than 2 grams per denier.

In a further aspect of the present invention the fibres may have a melting point greater than 265° C. and an initial modulus greater than 30 grams per denier and an elongation at break of greater than 25%, a tenacity of 2.2 grams per denier.

A further embodiment of the present invention provides that the fibres have a melting point of greater than 280° C. and an initial modulus greater than 32 grams per denier, an elongation at break greater than 30%, a tenacity of greater than 2.3 grams per denier and a creep extension of less than 8% at 1.5 gram per denier.

A further aspect of the present invention provides that the polyester material has carboxyl groups which are hindered by a moiety selected from cyclicaliphatic and branched aliphatic glycol. The polyester may be poly(1,4-cyclohexandicarbinyl terephthalate). In this polymer, the cyclohexane ring may be substituted such that the two carbinyl groups may exist in one of two configurations, i.e. the cis- or the trans-configuration. While the precise mechanism is not entirely understood, the cis-configuration imparts a relatively low melting point of the order of 220° C. while the trans-configuration has a high melting point approaching 300° C. and is highly crystalline.

The large size of the cyclohexane moiety within the polyester molecule serves to hinder a hydrolytic attack on the carboxyl group and is thought to provide improved hydrolysis resistance. At the same time, the thermal properties of the material can be controlled by selection of the relative proportions of the cis- and trans-isomers to produce a material which is eminently suitable for use in high temperature portions of a paper making machine such, for example, as a dryer screen.

The polyester material may include a proportion of a stabiliser. Typical stabilisers include carbodiimides present in an amount of 0.5 to 10%, preferably 1 to 4% by weight. The carbodiimide may be that of benzene-2,4-diisocyonato-1,3,5-tris(1-methylethyl) homopolymer or it may be that of a copolymer of 2,4-diisocyanato-1,3,5-tris(1-methylethyl) with 2,6-diisopropyl dissocyanate such, for example, as that commercially available under the trade name "STABAXOL P" or "STABAXOL P-100", respectively of Rhein-Chemie, of Rheinau GmbH, West Germany.

The polyester fibres either alone or incorporating the stabiliser typically have a tensile strength of 2.4 to 4.3 grams per denier. The fibres of the fibre structure in accordance with the present invention may further exhibit a thermal shrinkage at 200° C. of 0.2% to 20.5% with a tensile modulus within the range of 34 to 74 grams per denier. In a particular embodiment of the present invention, the polyester material may be poly(1,4-cyclohexanedicarbinyl terephthalate) and it has been found that the material commercially available under the trade name "KODAR THERMX copolyester 6761" (generally, a copolymer comprised of terephthalic acid, 1,4-dimethylolcyclohexane and isophthalic acid.) produced by the Eastman Chemical Products Inc., is particularly suitable in this regard.

As stated above, one of the more important features of paper machine clothing in accordance with the present invention is its potential use in high temperature sections of a paper making machine, in particular dryer fabrics and dryer screen fabrics, since the material from which it is made is not readily hydrolyzed. Unexpectedly, materials in accordance with the present invention show an exceptional degree of stability over time when compared with conventional polyester materials currently employed and it is not uncommon for the half life of the percent retained tensile strength for articles of paper machine clothing in accordance with the present invention to be 1.5 to twice that of the current industry standard.

While the invention is particularly concerned with materials suitable for use in the drying section of a paper making machine, it will be appreciated by the person skilled in the art that with the tendency towards ever higher temperatures in the forming and pressing sections of a paper making machine, articles of paper making clothing in accordance with the present invention can well be produced for use in both the pressing section and the forming section. In the forming section it is possible to form an open weave using monofilament materials which allow for adequate support of the solid materials in the furnish and yet allow sufficient dewatering to produce a coherent sheet preparatory to pressing. In the pressing section, by providing both the support layer and at least a proportion of the surface layer of the pressing fabric in accordance with the present invention, pressing fabrics much more tolerant of high temperature operation are produced.

The invention, therefore, is concerned not only with the production of paper machine clothing (PMC) materials which may be of woven or spiral or of other suitable monofilament structures, in which monofilaments may extend in both the machine direction and the cross direction of the fabric, but also include other PMC structures. Such polyester may be used to produce PMC fabrics comprised of staple, multifilament, and/or monofilament fibres.

Typical range of sizes of monofilaments used in Press Fabrics and Dryer Fabrics are 0.20 mm–1.27 mm in diameter or the equivalent mass in cross-section in other cross-section shapes, e.g. square or oval.

For forming fabrics finer monofilaments are used, e.g. as small as 0.05 mm. While special Industrial applications may use monofilaments up to 3.8 mm.

Following is a description by way of example only and with reference to the accompanying drawing of methods of carrying the invention into effect.

EXAMPLE 1

A polyester commercially available under the trade name "KODAR THERMX copolyester 6761" (generally, a copolymer comprised of terephthalic acid, 1,4-dimethylolcyclohexane and isophthalic acid.) supplied by the Eastman Chemical Products Inc. was extruded in a 25 mm single screw extruder having a screw with a compression ratio of 4.12 and a 40 mesh screen filtration at the end of the barrel. The material was spun after filtration through a 325 mesh screen supported by an 80 mesh screen through a multi-hole die with each hole having a diameter of 0.625 mm (0.025"), land length of 1.9 mm. The air gap after extrusion was 32 mm and the quench water temperature was 66° C. The resultant extrudate was subjected to an overall draw ratio which varied from 3.0 to 4.8 thereby producing a range of denier of the monofilaments.

TABLE 1

| | | UNSTABILIZED FIBER PROPERTIES | | | |
|---|---|---|---|---|---|
| SAMPLE (Al NB No.) | AVERAGE DENIER | OVERALL DRAW RATIO | TENACITY (gpd) | ELONGATION AT BREAK (%) | INITIAL MODULUS (%) |
| 3458-63-1 | 393 | 4.4 | 3.7 | 12 | 63 |
| 3458-63-2 | 371 | 4.8 | 4.5 | 8 | 80 |
| 3458-64-1 | 388 | 4.4 | 3.7 | 7 | 79 |
| 3458-64-2 | 506 | 3.4 | 2.6 | 26 | 55 |
| 3458-65-1 | 560 | 3.0 | 2.5 | 38 | 43 |
| 3458-65-2 | 424 | 4.0 | 3.7 | 18 | 59 |
| 3458-65-3 | 422 | 4.0 | 3.6 | 16 | 57 |

EXAMPLE 2

The experiment as defined in Example 1 was repeated for a proportion of the same copolyester material having various proportions of up to 5% by weight of a carbodiimide stabilizer material commercially available under the trade name "STABAXOL P-100". The properties of the monofilament as extruded and drawn are set out in Table 2.

TABLE 2

| SAMPLE (Al NB No) | AVERAGE DENIER | STABILIZED FIBER PROPERTIES STABILIZER CONTENT (%) | TENACITY (gpd) | ELONGATION AT BREAK (%) | INITIAL MODULUS (gpd) |
|---|---|---|---|---|---|
| 3458-90-1 | 432 | 5.0 | 3.5 | 18 | 53 |
| 3458-91-4 | 431 | 3.0 | 3.5 | 18 | 53 |
| 3458-91-9 | 430 | 1.5 | 3.6 | 18 | 53 |

NOTE-OVERALL DRAW RATIO FOR ALL SAMPLES IS 4.0

Figure 1:
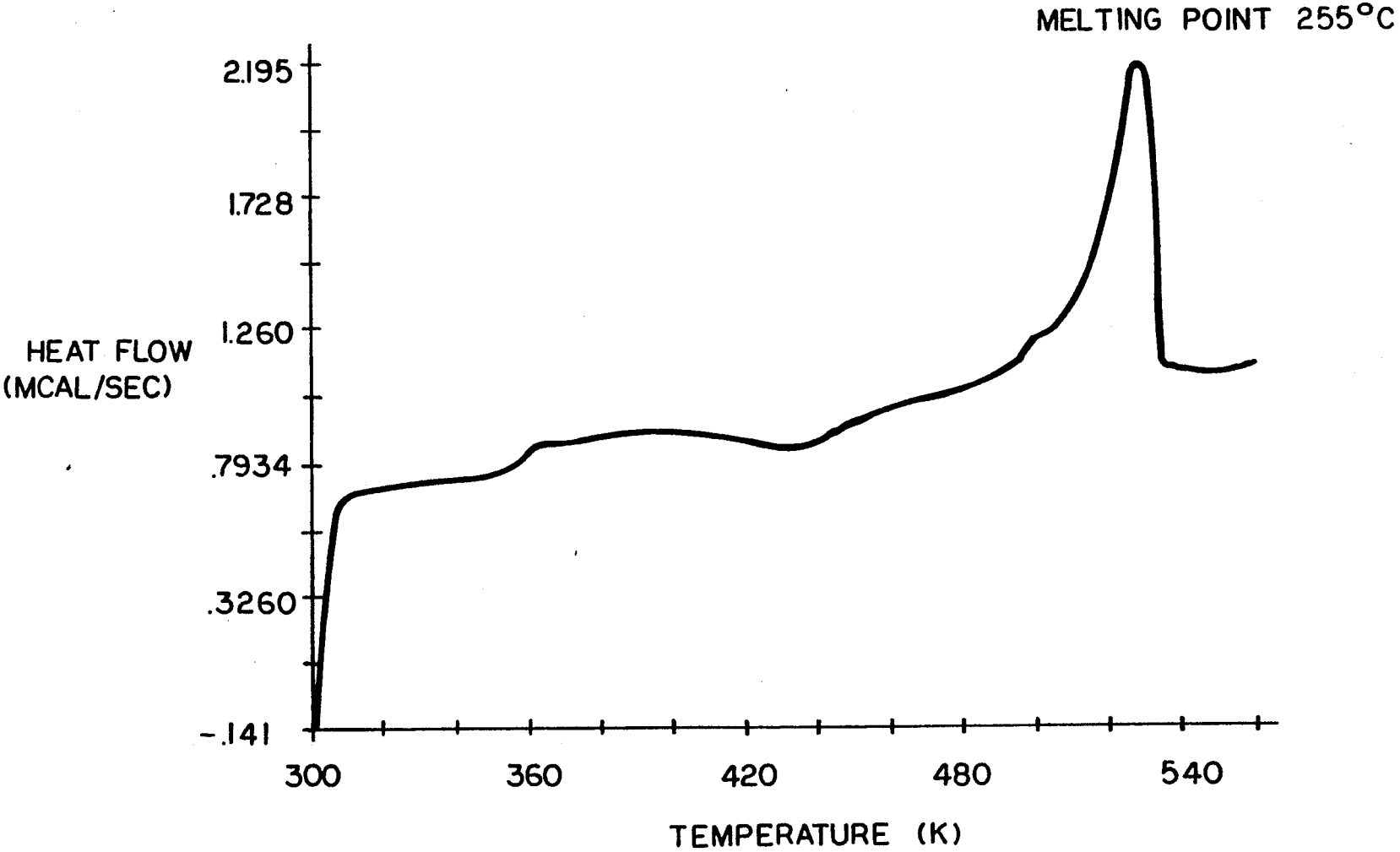
FIG. 1 is a graph of a differential scanning calorimetry response of a commercial polyester sample having a melting point of 255° C.
Figure 2:
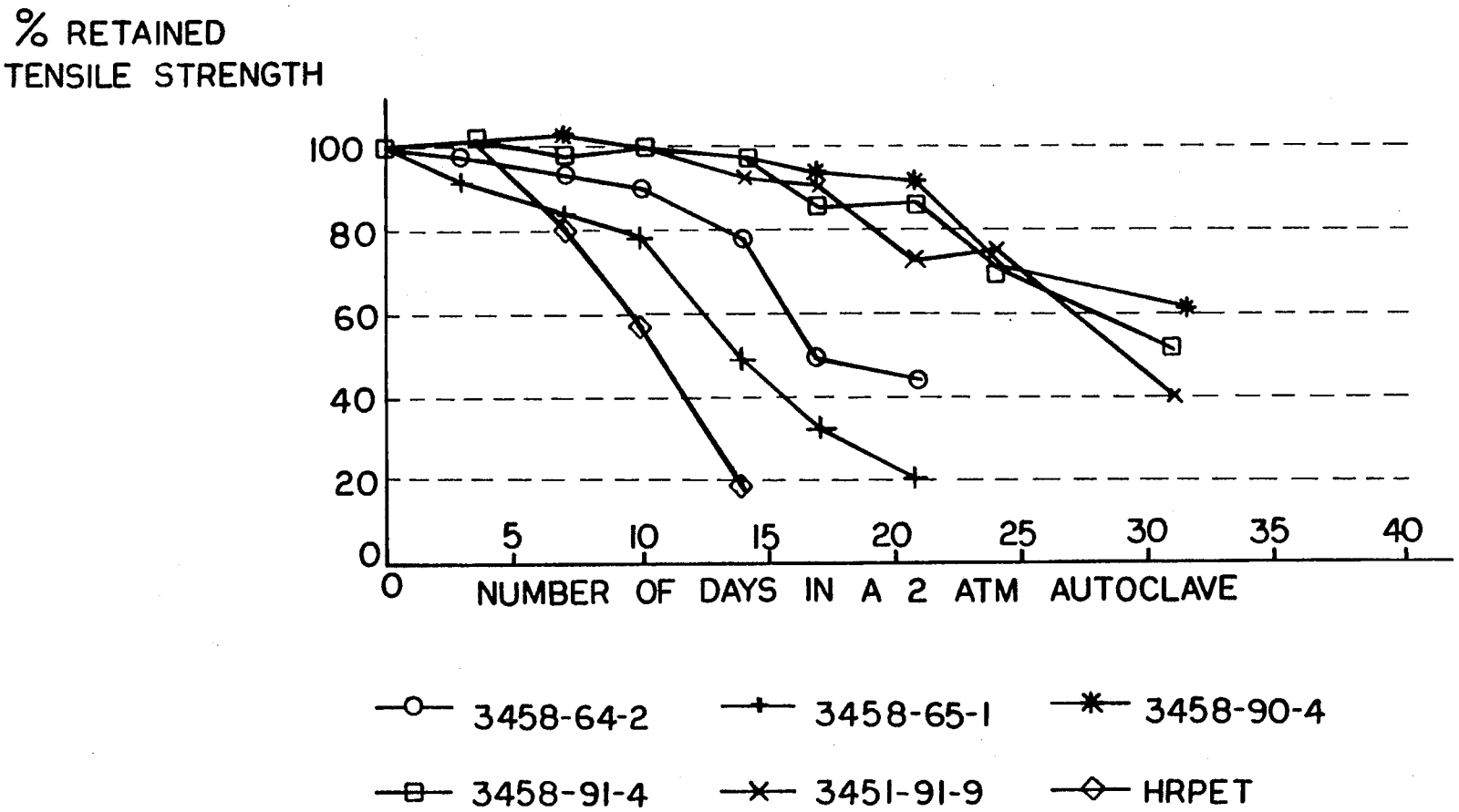
FIG. 2 is a graph showing the variation of hydrolysis resistance against time for various samples.

FIG. 2 shows graphically how the hydrolysis resistance of the various stabilized and unstabilized monofilaments described in Examples 1 and 2 behave over a period of 32 days when subjected to saturated steam in an autoclave at a pressure of 2 atm absolute pressure. The five samples of Table 2 are illustrated together with a commercial monofilament produced from poly(ethylene terephthalate) and stabilized with a cabodiimide. The significant point on the graph is the period in which the retained tensile strength has been reduced to 50%.

From FIG. 2 it will be seen that the three samples which had the carbodiimide stabiliser present, retained their tensile strength over a longer period, in some cases more than double that of the other three samples which did not contain stabiliser. And in all samples, both stabilized and unstabilized, hydrolysis resistance was superior to that of conventional poly(ethylene terephthalate) stabilized with a carbodiimide.

Sample fabrics of extruded material were formed into dryer screen fabrics by weaving the monofilament in both the machine and cross-machine directions. The fabrics were run in a dryer section vis-a-vis presently used fabrics of poly(ethylene terephthalate), both alone and with stabilisers. It was found that the life of the fabrics in accordance with the present invention, showed a significant increase over those manufactured from traditional materials such as poly(ethylene terephthalate).

EXAMPLE 3

"KODAK THERMX copolyester 6761" (generally, a copolymer comprised of terephthalic acid, 1,4-dimethylolcyclohexane and isophthalic acid.) was fed to a 25 mm extruder having a single flighted screw having a compression ratio of 4.12. A metering pump was attached to the extruder and used to meter polymer to a spin pack. The spin pack contained filters which were comprised of a 400 mesh screen supported by a 200 mesh screen, which was supported by an 80 mesh screen. The spin pack also contained a die having 8 holes each hole having a diameter of 1.3 mm. Polymer was extruded vertically from the die into a water quench bath. The air gap between the die face and quench bath was 32 mm. The quench bath temperature was 66° C.

The extruded filament travelled through the bath for an approximate quench length of 0.8 mm. The filament exited the bath horizontally and travelled to a first roll stand operating at a speed of 8 m/min. The filament then passed through a hot air circulating oven operating at 121° C. The oven was 1.6 meters long. The filament exited the oven and travelled to a second roll stand operating at 28 m/min. The filament then passed through a second oven operating at 149° C. and travelled to a third roll stand operating at 39 m/min. The second oven had a length of 1.6 meters. The filament then passed through a third oven operating at 177° F. and passed to fourth roll stand operating at a speed of 32 m/min. The third oven had a length of 1.6 meters. The oriented monofilament was then collected on a spool via a tension controlled winder. The product when tested had a tensile strength of 3.4 gpd, an elongation at break of 23.5%, an initial tensile modulus of 41.0 gpd and a thermal free shrinkage at 200° C. of 7.6%.

EXAMPLE 4

This Example is similar to Example 3 with the following changes in roll stand speeds. The speeds for the first, second, third and fourth roll stands were 8, 28, 28 and 25 m/min, respectively. The product which resulted had a tensile strength of 2.7 gpd, an elongation at break of 34.8%, an initial tensile modulus of 36.3 gpd and a thermal free shrinkage at 200° C. of 4.6%.

EXAMPLE 5

This Example is similar to Examples 3 and 4, equipment wise, but with changes in both oven temperatures and roll stand speeds. The oven temperatures were 177°, 204° and 500° for ovens one, two and three, respectively. The speeds for the first, second, third and fourth roll stands were 8, 36, 39 and 39 m/min, respectively. The product which resulted had a tensile strength of 4.6 gpd, an elongation at break of 7.4%, an initial tensile modulus of 74.4 gpd and a thermal free shrinkage at 200° C. of 11.6%.

EXAMPLE 6

This Example is similar to Example 5 with the following changes in roll stand speeds. The speeds for the first, second, third and fourth roll stands were 8, 32, 32 and 32 m/min, respectively. The product which resulted had a tensile strength of 4.0 gpd, an elongation at break of 18.0%, an initial tensile modulus of 55.3 gpd and a thermal free shrinkage at 200° C. of 5.9%.

EXAMPLE 7

"KODAR THERMX copolyester 6761" (generally, a copolymer comprised of terephthalic acid, 1,4-dimethylolcyclohexane and isophthalic acid.) and "STABAXOL P" at a concentration of 2.2% was fed to a 50 mm extruder having a single barrier flighted screw having a compression ratio of 3.1. A metering pump was attached to the extruder and used to meter polymer to a spin pack. The spin pack contained filters which were comprised of a 180 mesh screen supported by a 250 mesh screen, which was supported by a 60 mesh screen. The spin pack also contained a die having 10 holes each having a diameter of 1.5 mm. Polymer was extruded vertically from the die into a water quench bath. The air gap between the die gace and the quench bath was 30 mm. The quench bath temperature was 66° C. The extruded filament exited the bath horizontally and travelled to a first roll stand operating at a speed of 20 m/min. The filament then passed through a hot air circulating oven operating at 121° C. The oven was 2.7 meters long. The filament exited the oven and trvelled to a second roll stand operating at 69 m/min. The filament then passed through a second oven operating at 191° C. and travelled to a third roll stand operating at 70 m/min. The second oven had a length of 2.4 meters. The filament then passed through a third oven operating at 268° C. and passed to a fourth roll stand operating at a speed of 62 m/min. The third oven had a length of 2.7 meters. The oriented monofilament was then collected on a spool via a tension controlled winder. The product when tested had a tensile strength of 2.5 gpd, an elongation at break of 33%, and an initial modulus of 32 gpd.

Figure 3:
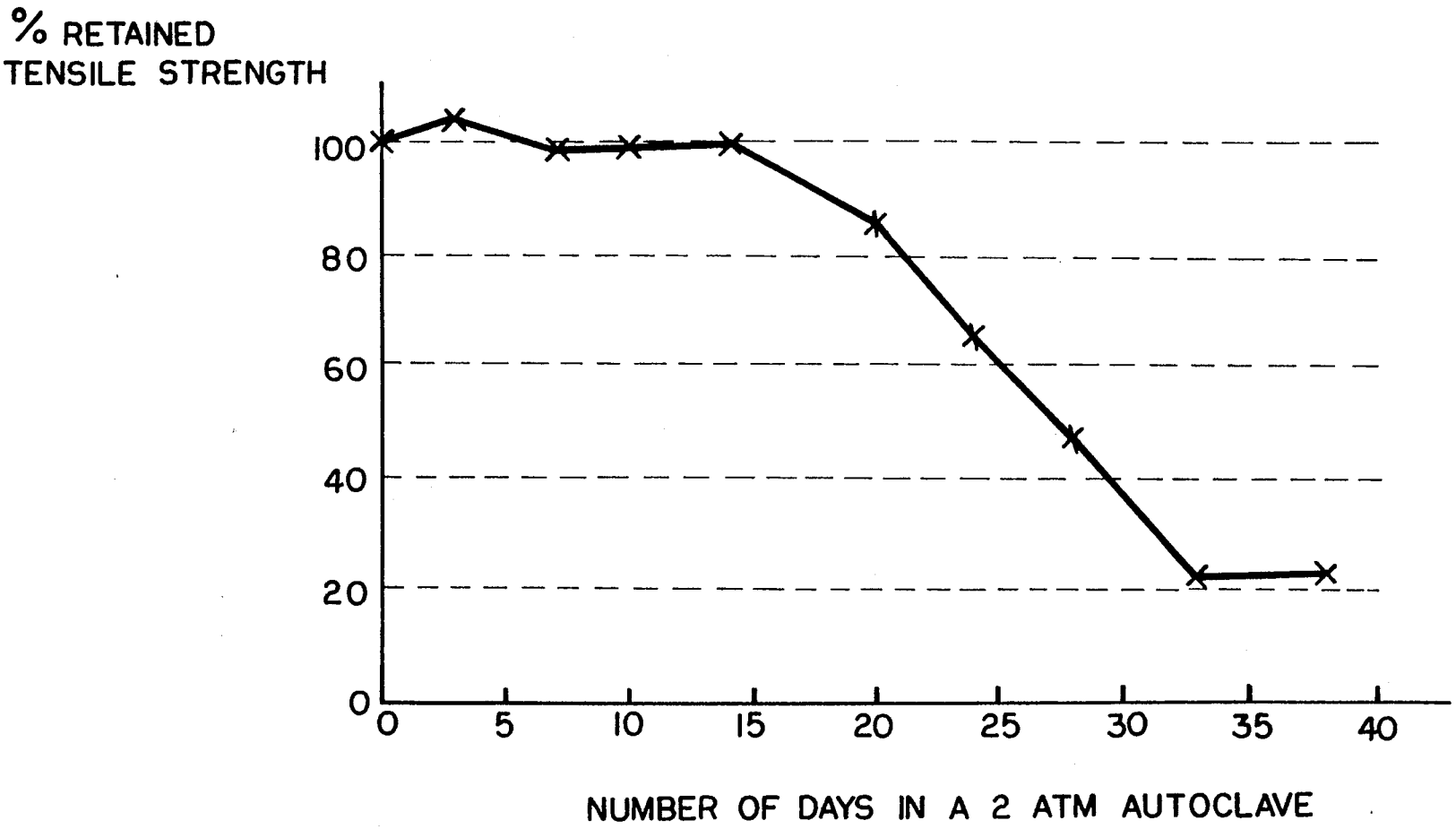
FIG. 3 is a plot of retained tensile stregth of a polyester sample with time in an autoclave as set out in Example 7.

FIG. 3 shows graphically how the hydrolytic resistance of the stabilized monofilament described in Example 7 behaves over a period of 38 days when subjected to saturated steam in an autoclave at a pressure of 2 atm absolute pressure.

EXAMPLE 8

"KODAR THERMX copolyester 6761" (generally, a copolymer comprised of terephthalic acid, 1,4-dimethylolcyclohexane and isophthalic acid.) and "STABAXOL P" at a concentration of 2.5% was fed to a 70 mm extruder having a single barrier flighted screw having a compression ratio of 2.5. A metering pump was attached to the extruder and used to meter polymer to a spin pack. The spin pack contained filters which were comprised of a 180 mesh screen supported by a 250 mesh screen, which was upported by a 60 mesh screen. The spin pack also contained a die having 50 holes each having a diameter of 1.5 mm. Polymer was extruded vertically from the die into a water quench bath. The air gap between the die face and the quench bath was 57 mm. The quench bath temperature was 63° C. The extruded filament exited the bath horizontally and travelled to a first roll stand operating at a speed of 17 m/min. The filament then passed through a hot air circulating oven at 179° C. The oven was 2.7 meters long. The filament exited the oven and travelled to a second roll stand operating at 58 m/min. The filament then passed through a second oven operating at 231° C. and travelled to a third roll stand operating at 58 m/min. The second oven had a length of 2.7 meters. The filament then passed through a third oven operating at 257° C. and passed to a fourth roll stand operating at a speed of 52 m/min. The third oven had a length of 2.7 meters. The oriented monofilament was then collected on a spool via a tension controlled winder. The product when tested had a tensile strength of 2.6 gpd, an elongation at break of 39%, and an initial modulus of 32 gpd.

Figure 4:
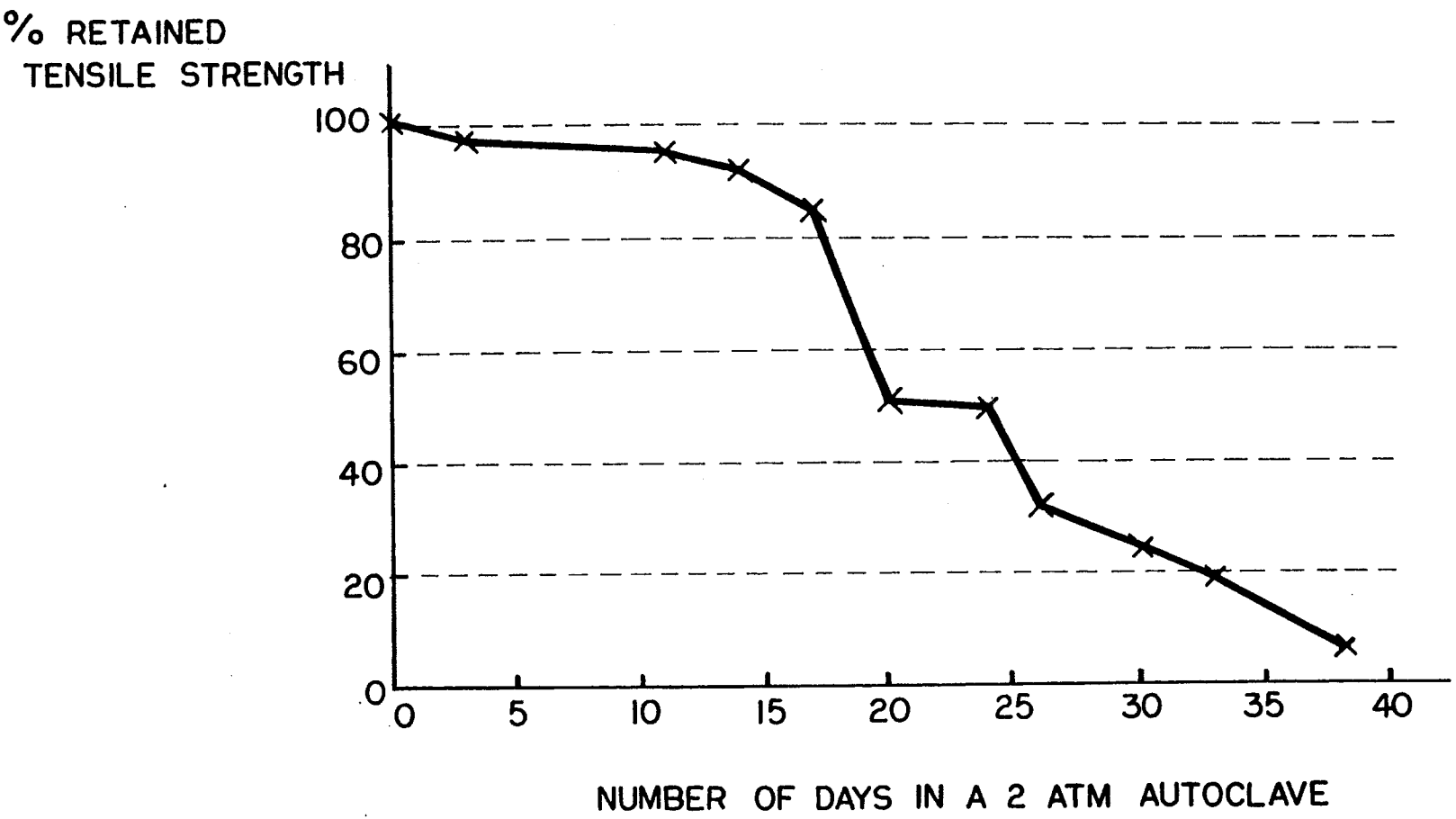
FIG. 4 is a plot similar to FIG. 3 for the sample of Example 8.

FIG. 4 shows graphically how the hydrolytic resistance of the stabilized monofilament described in Example 8 behaves over a period of 38 days when subjected to saturated steam in an autoclave at a pressure of 2 atm absolute pressure.

We claim:

1. An article of paper machine clothing used in the forming, pressing or drying sections of a papermaking machine, which article includes a fibre structure characterized in that the fibres of said structure consist essentially of a woven polyester material which is a copolymer of terephthalic acid, 1,4-dimethylolcyclohexane and isophthalic acid the polyester material exhibiting an increase in life of the clothing relative to clothing comprised of polyethylene terephthalate, and said fibres have a melting point greater than 260° C.

2. An article as claimed in claim 1 wherein the fibers are characterized by a creep extension of less than 10% at 1.1 gpd.

3. An article as claimed in claim 1 further characterised in that the fibres have an initial modulus greater than 25 gpd, an elongation at break of greater than 15%, and a tenacity greater than 2 gpd.

4. An article as claimed in claim 1 characterised in that said fibres have a melting point greater than 265° C., an initial modulus greater than 30 gpd, an elongation at break greater than 25%, a tenacity of 2.2 gpd.

5. An article as claimed in claim 1 characterised in that said fibres have a melting point greater than 280° C., an initial modulus greater than 32 gpd, an elongation at break greater than 30%, a tenacity greater than 2.3 gpd.

6. An article as claimed in claim 1 characterised in that the polyester material includes an effective amount of a stabiliser.

7. An article as claimed in claim 6 characterised in that the stabiliser is present in an amount of 0.5% to 10.0% by weight.

8. An article as claimed in claim 6 characterised in that the stabiliser is a carbodiimide.

9. An article as claimed in claim 8 characterised in that the carbodiimide is benzene-2,4-diisocyanate-1,3,5-tris(1-methylethyl) homopolymer.

10. An article as claimed in claim 8 characterised in that the carbodiimide is a copolymer of benzene 2,4-diisocyanato-1,3,5-tris(1-methylethyl) and 2,6-diisopropyl diisocyanate.

11. An article as claimed in claim 1 characterised in that the fibre is a monofilament of either round or other shaped cross-sections.

12. An article as claimed in claim 11 in which said fibres are monofilaments extending in the machine direction.

13. An article as claimed in claim 11 in which said fibres are monofilaments extending in the cross machine direction.

14. An article of paper machine clothing used in the forming, pressing or drying sections of a papermaking machine, which article includes a fibre structure characterized in that the fibres of said structure consist essentially of a woven polyester material which is a copolymer of terephthalic acid, 1,4-dimethylolcyclohexane and isophthalic acid the polyester fiber material being selected on the basis of its ability to be woven into a papermachine clothing, said fibres have a melting point greater than 260° C.

15. An article of paper machine clothing used in the forming, pressing or drying sections of a papermaking machine, which article includes a fibre structure characterized in that the fibres of said structure consist essentially of a woven polyester material which is a copolymer of terephthalic acid, 1,4-dimethylolcyclohexane and isophthalic acid the clothing made of said polyester material exhibiting improved wear resistance and duration of use relative to paper machine clothing made of polyethylene terephthalate, and said fibres have a melting point greater than 260° C.

* * * * *

US005169499A

REEXAMINATION CERTIFICATE (2300th)

United States Patent [19]

[11] B1 5,169,499

Eagles et al.

[45] Certificate Issued May 10, 1994

[54] PAPER MACHINE FELTS OF A COPOLYMER OF 1,4-DIMETHYLOCYCLOHEXANE, TEREPHTHALIC ACID, AND ISOPHTHALIC ACID

[75] Inventors: Dana B. Eagles, Sherborn; Jeanne A. Leon, Westwood; Francis Ditaranto, Plainville, all of Mass.

[73] Assignee: Albany International Corp., Albany, N.Y.

Reexamination Request:
No. 90/003,132, Jul. 19, 1993

Reexamination Certificate for:

| | |
|---|---|
| Patent No.: | **5,169,499** |
| Issued: | **Dec. 8, 1992** |
| Appl. No.: | **678,292** |
| Filed: | **Apr. 4, 1991** |

[22] PCT Filed: Apr. 23, 1990

[86] PCT No.: PCT/GB90/00623

§ 371 Date: Apr. 4, 1991

§ 102(e) Date: Apr. 4, 1991

[87] PCT Pub. No.: WO90/12918

PCT Pub. Date: Nov. 1, 1990

[30] Foreign Application Priority Data

Apr. 24, 1989 [GB] United Kingdom ..... 8909291
Jun. 15, 1989 [GB] United Kingdom ..... 8913731
Nov. 6, 1989 [GB] United Kingdom ..... 8924996

[51] Int. Cl.[5] ..... D21F 7/08; D01F 6/62

[52] U.S. Cl. ..... 428/175; 162/358.2; 162/900; 162/902; 162/903; 428/234; 428/287

[58] Field of Search ..... 162/348, 358.2, 900, 162/902, 903; 428/175, 234, 287; 34/243

[56] References Cited

U.S. PATENT DOCUMENTS

| | | | |
|---|---|---|---|
| 2,901,466 | 8/1959 | Kibler et al. | 260/75 |
| 3,975,329 | 8/1976 | Barnewall et al. | 260/75 T |
| 4,332,761 | 6/1982 | Phillips et al. | 264/147 |

*Primary Examiner*—Karen M. Hastings

[57] ABSTRACT

This invention relates to a paper machine clothing having improved hydrolysis resistance and suitable for use in the forming, pressing or drying sections of a paper making machine, and has particular reference to paper making machine clothing used in the dryer section of a paper making machine, such as through air drying fabrics, and dryer screens.

According to one aspect of the present invention, there is provided an article of paper making machine clothing suitable for use in the forming, pressing or drying sections of a paper making machine which article includes a fibre structure characterized in that the fibres of said structure comprise a polyester material having a hintered carboxyl group and in that said fibres have a melting point greater than 260° C. The fibres are a copolymer of terephthalic acid, 1,4-dimethylolcyclohexane and isophthalic acid.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-15 is confirmed.

* * * * *